United States Patent [19]

Galvin

[11] Patent Number: 4,961,587

[45] Date of Patent: Oct. 9, 1990

[54] PADDLE TOSS BALL GAME

[76] Inventor: Patrick J. Galvin, 39 Lynwood Dr., Wolcott, Conn. 06716

[21] Appl. No.: 482,764

[22] Filed: Feb. 21, 1990

[51] Int. Cl.[5] ..... A63B 67/00; A63B 71/06

[52] U.S. Cl. ..... 273/411; 273/381; 273/386

[58] Field of Search ..... 273/411, 378, 333, 357, 273/383, 386, 390, 381

[56] References Cited

U.S. PATENT DOCUMENTS

| | | | |
|---|---|---|---|
| 437,267 | 9/1890 | Walker | 273/386 |
| 773,167 | 10/1904 | Spink | 273/333 |
| 854,640 | 5/1907 | Fuller | 273/381 |
| 1,612,946 | 1/1927 | Scarseth | 273/386 |
| 4,135,559 | 1/1979 | Barnby | 273/357 X |
| 4,523,762 | 6/1985 | Garner, Sr. | 273/411 |

*Primary Examiner*—William H. Grieb

*Attorney, Agent, or Firm*—Lawrence Hager

[57] ABSTRACT

A game device and method of playing same. The game/toy device generally comprises a paddle wheel which is rotatably mounted between two spaced apart support posts that are vertically mounted to a playing court. An alarm system is coupled to the paddle wheel to signify or sound a signal indicative of a winner. Competing players take turns of tossing a ball at the paddle wheel from opposite side of the target paddle wheel. Each player attempts to rotate the paddle wheel a number of turns to raise his respective scoring weight up to a sensor. Activation of the sensor energizes the win signal.

6 Claims, 1 Drawing Sheet

PADDLE TOSS BALL GAME

FIELD OF THE INVENTION

The present invention relates to a game/toy device and method of playing same and, more particularly, to a compact, relatively inexpensive, safe and easy to play game and toy for use on a lawn, court or other areas.

BACKGROUND OF THE INVENTION

The lawn type games exemplified in the prior art typically are complex, relatively expensive, require difficult to understand instructions and rules and many are dangerous for young children. Safety is of high importance and the present invention is relatively safe and uncomplicated for children to play.

PRIOR ART STATEMENT

A known lawn game device is shown in U.S. Pat. No. 4,523,762 issued June 18, 1985 to Ronald S. Garner, Sr.

Other prior art patents of interest include U.S. Pat. Nos.: 437,267 issued Sept. 30, 1890 to L. C. Walker; 773,167 issued Oct. 25, 1904 to F. E. Spink.

These patents are mentioned as being representative of the prior art and other pertinent references may exist. None of the above cited patents are deemed to affect the patentability of the present claimed invention.

The present invention involves a novel combination of features combined in such a way as to afford a very efficient, relatively inexpensive game/toy which has significant advantages over the prior art that will become more apparent as the description proceeds.

For example, in contrast to the prior art, the present invention provides a simple and easy to use/play one-handed or two handed game that can be played by one or more participants on one or both sides of the target line; is a relatively safe yet competitive game for all ages; can be played in confined or open areas such as yards, on beaches, gymnasiums, tennis - badminton - vollyball or basketball courts, etc.; and/or a single backboard type court or wall can be utilized to rebound the ball for practice or play.

SUMMARY OF THE INVENTION

Generally speaking, in accordance with the invention, a paddle wheel-toss ball game is provided which utilizes a pair of spaced apart vertically mounted support poles, a rod or tube rotatably mounted between said pair of support poles, a plurality of paddles radially affixed to said tube, a first score indicator means mounted at a first end of said tube, a second score indicator means mounted at a second end of said tube, and a ball or other small object which can be tossed at the paddles.

The game is played or practiced by a single player by locating the game device, i.e., the support poles and mounted paddle wheel, etc., in a juxtaposition to a backboard wall. The player is positioned behind a foul line or shooting line marked on the ground or court at a predetermined distance from the paddle wheel. The predetermined distance may be selected to accommodate the age, ability, etc. of the player, the player thence proceeds to throw the ball at the paddle wheel. The object of the game is to hit and rotate the paddle wheel. The object is to rotate the paddle wheel enough turns to raise the score indicator to the win position.

With two or more players, the paddle wheel target is positioned to enable disposition of players on opposite sides of the target line. Each player is located on or about a shooting or foul line, for example, equidistant from the target paddle wheel. The degree of difficulty and/or the point scoring increases as the distance from the target paddle wheel.

A handicap system may be established by varying the distances of the competitors from the target paddle wheel. In this manner, handicap adjustments, for example, child versus adult, or old aged versus young aged or male versus female competitors, can be implemented to increase competitive play.

A coin flip is sufficient to start the game. Player A tosses a ball generally underhand toward Player B, with the goal of hitting the target paddle wheel and, thereby, displacing the score indicator to a higher position. Player B then gets the opportunity to return toss the ball toward Player A, again with the goal of hitting the target paddle wheel and, thereby, displacing his score indicator to a higher position.

Single or multiple games or sets can be played and, a game, set and match scoring procedure utilized similar to the game of tennis. However, the present invention provides a relatively less expensive, less difficult to learn and play game than tennis, while enabling differently skilled players to compete against each other with a handicapping system comprised of multiple distant foul lines.

OBJECTIVES OF THE INVENTION

Accordingly, it is an object of the present invention to provide a new and improved game.

Another object of the present invention is to provide a new and improved toss ball and paddle wheel game device.

Another object of the present invention is to provide a compact, portable and relatively simple to play game.

Another object of the present invention is to provide a relatively inexpensive ball and paddle wheel game device.

Another object of the present invention is to provide a versatile, ball and paddle wheel game capable of being played by one player, two players or opposing teams.

Another object of the present invention is to provide a paddle wheel game which can accommodate different skill/ability players while presenting a competitive challenge to each player.

Another object of the present invention is to provide a relatively safe and inexpensive yard game for children designed to avoid injuries.

BRIEF DESCRIPTION OF THE DRAWINGS

Other objects and advantages of the present invention may be more clearly seen when viewed in conjunction with the accompanying drawings. Similar reference numerals refer to similar parts throughout.

DESCRIPTION OF THE PREFERRED EMBODIMENTS

Figure 1:
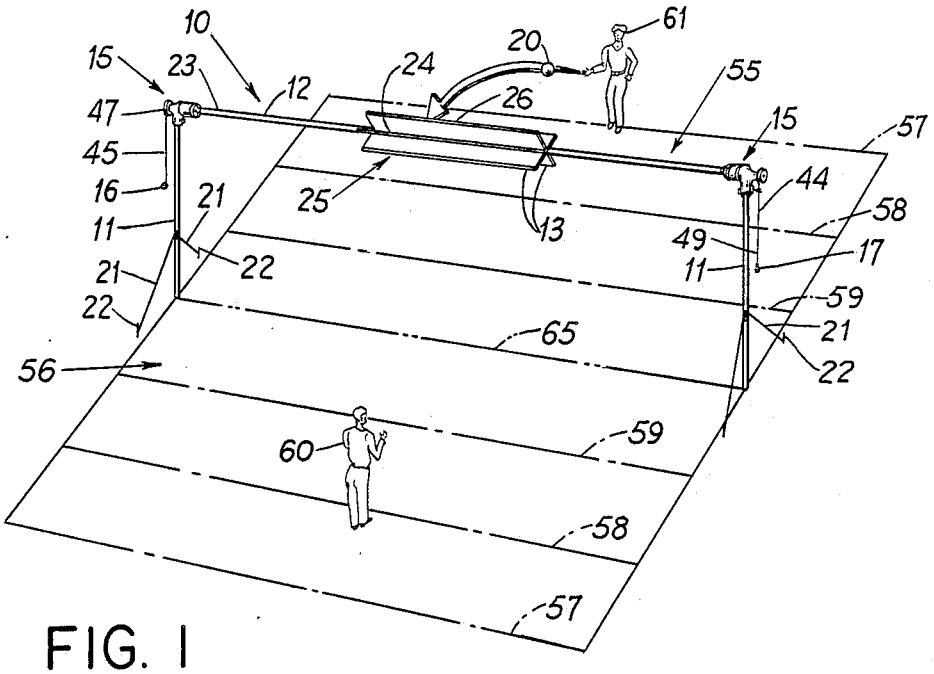
FIG. 1 is a perspective view of the paddle wheel game device being played by two players in accordance with the invention.

Referring to the drawings, particularly FIG. 1, there is shown a paddle wheel game-device 10 constructed and being played in accordance with the present invention and to have a simple, robust structure easy to set up and easy to play by one or more persons, comprising a playing court (55, 56) having a center line (65), a first foul-line position (59), a second foul-line position (58), and a third foul-line position (57).

Basically speaking, the paddle wheel game-device 10 comprises a pair of spaced apart support poles 11, a pole or tube or pipe or rod 12, a plurality of paddles 13, a pair of pully mounting means 15, a pair of score weights 16, 17, a sensor means, alarm means, and at least one ball or other such item 20.

The support poles 11 are vertically supported/-mountable in a conventional manner such as by tension tie down cables 21 which are secured, for example, by stakes 22, to the earth. Alternatively, a support base or stand (not shown) may be utilized which is weighted to provide the necessary pole support and does not require cables or stakes.

Rod 12 may be constructed of plastic or any other suitable material.

Rod 12 is rotatably mounted at its opposite ends 23 to an upper portion of each support pole 11, by a pully mounting means 15.

A plurality of paddles or plates or boards 13 are each affixed in a conventional manner at their respective bottom edges 24 to rod 12. Each paddle 13 may be formed of any suitable material such as plastic to generally have a rectangular configuration. The dimension of the paddles may be selected for a desired sized paddle wheel game-device 10. In accordance with the preferred embodiment, each paddle 13 has a length between six inches and thirty-six inches and a height between three inches and twelve inches. The paddles 13 as equidistantly spaced about rod 12 to form a paddle wheel 25 configuration. The number of paddles comprising said paddle wheel may be empirically determined to present suitable target areas 26.

Figure 2:
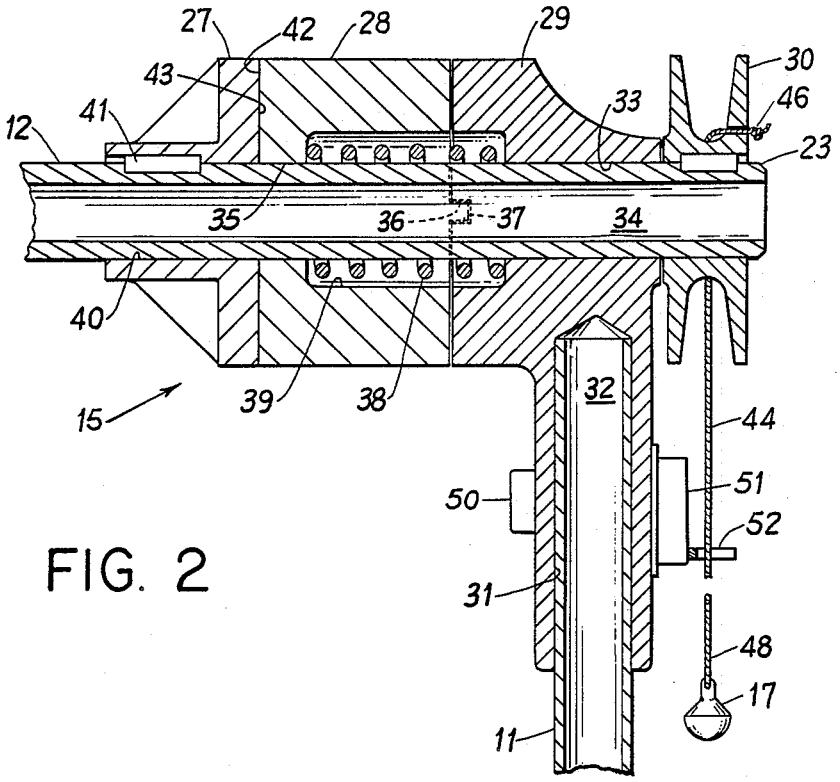
FIG. 2 is a side cut-away view of an embodiment of a pully mounting mean in accordance with the invention.

Each pully mounting means 15 (see FIG. 2) in accordance with the preferred embodiment, generally comprises a skid plate 27, a clutch plate 28, a base member 29 and string pully 30.

Each base member 29 has an aperture 31 dimensioned to snugly receive an upper end portion 32 of one of said pair of support poles 11, and a hole 33 dimensioned to rotatably mount an intermediate end portion 34 of rod 12.

Clutch plate 28, being tube shaped, is slidably mounted, via hole 35, about rod 12. A key 36 is laterally slidably received in key way 37 of base member 29, to enable slight lateral movement of clutch plate 28, while restricting rotation thereof. Spring means 38, of conventional design is confined within cavity 39 for urging clutch plate 28 into skid contact with skid plate 27.

Skid plate 27, being collar shaped with a central hole 40, is mounted about rod 12 and key locked 41 thereto. In this manner, each skid plate 27 rotates coincidentally with rod 12.

The tension of spring means 38 may be empirically determined or selected such that a desired rotation of paddle wheel 25 and, therefore, rod 12 is effect with a slow, average or fast tossed ball making contact with a paddle 13. Thus, the clutch mechanism affect between the contacting surfaces 42, 43 of clutch plate 28 and skid plate 27, respectively, prevents excessive rotation. In addition this clutch mechanism affect is selected and designed to maintain the paddle wheel disposition in opposition to the rotational force being applied via each string pully 30, string 44, 45, and score weight 16, 17. Spring means 38 is a coil spring of conventional design for biasing clutch plate 28 outwardly from base member 29.

String 44, 45 is secured at one end 46, 47, to a respective string pully. The other or bottom end 48, 49, of each string 44, 45 is affixed to a score weight, 16, 17, respectively.

Score point indicia 50 may be provided on each side of each support pole 11.

An alarm system 51 may be provided on each support pole 11. Each alarm system 51 may be of conventional design such as a battery powered lever 52 actuated switch and bell alarm. Lever 52 being actuatably mounted to a selected win position on a respective support pole 11. Each lever being operatively connected to the switch and bell alarm circuit (not shown and of conventional design). Functionally, with rotation of paddle wheel 25, rod 12, and string pully 30, string 44 is wound about pully 30, thereby elevating score weight 17. As paddle wheel 25 continues to be rotated in the same rotational direction, score weight 17 engages lever 52, thereby activating a win alarm signal.

The paddle wheel and toss ball game is typically played by two individuals or two teams, who compete against each other.

The paddle wheel game device is set-up on a yard, lawn or playing field or court substantially as shown in FIG. 1, to provide a playing field 55 and 56 on both sides of the paddle wheel 25.

Each playing field has a plurality of skill goal lines 57, 58, and 59.

Each player 60, 61 selects a goal line 57, 58, or 59 from which to complete/play from. The selected goal line may be changed by the players in order to accommodate for different skill, age and physical abilities.

The rules of the game are generally simple to understand and follow.

First, a winning score is achieved when respective players' 60, 61 score weight, 16, 17, is elevated to the win position or score of 100 illustrated by score indicia 50, which actuates a win alarm signal.

Second, one of the players is selected to toss-ball first. The selection method may be of conventional method such as by flipping a coin.

Third, the first player 61 tosses the ball 20 at the top of the paddle wheel 25. If a paddle 13 of paddle wheel 25 is hit by the ball 20, paddle wheel 25 is caused to rotate. This rotational dislocation causes elevation of score weight 16 and a lowering of his opponents score weight 17 to a negative score. Thus, each player can score point for himself while subtracting points from his opponent.

Each player takes turns at tossing ball 20 at the paddle wheel 25.

Fourth, the second player 60, is given the opportunity to score points by tossing the ball 20 at paddle wheel 25.

This alternating of turns continues until either player activates the alarm system. However, if the alarm signal is activated by the first player 61, the second player, 60 is given the final toss. If the second player 60, hits the paddle wheel 25 and rotates same, the first players score is reduced and the alarm deactivated. Thus, the second player always gets the last toss. Therefore, any advantage the first player 61 obtained by tossing first is off-set by the second player being the last to toss. Accordingly, for the first player to win, he must obtain a winning score and the second play must miss or fail to score with his last toss.

In this manner, a portable, compact, relatively inexpensive, easy to learn and play game device is provided which effects relatively safer, easier and more economical court type game activity, which obviates the need for expensive rackets.

While there has been shown what is considered to be the preferred embodiments of the invention, it should be apparent to those skilled in the art that numerous modifications may be made thereto without departing from the spirit and scope of the invention.

I claim:

1. A game device having particular utility for being played by two or more persons, comprising:
   - a pair of support poles;
   - a rod rotatably mounted between said pair of support poles;
   - at least one paddle board affixed to an intermediate portion of said rod;
   - a string collection means affixed to and coincidentally rotated with said rod;
   - a line secured at a top end to said string collection means and having a bottom end for hanging downwardly from said string collection means;
   - a score weight affixed to said bottom end of said line; and
   - a toss ball dimensioned for being hand held and tossed at said paddle board.

2. A game device as in claim 1, wherein:
   - the support poles are spaced apart and vertically mounted at a lower end and having a predetermined length.

3. A game device as in claim 1 wherein:
   - a plurality of paddle boards being affixed to said rod to form a paddle wheel of generally equidistant and radially outwardly projecting paddle boards.

4. A game device as in claim 1 including:
   - an alarm means being operatively actuated by a predetermined position of said score weight for providing a win signal.

5. A game device as in claim 1, wherein:
   - the string collection means includes a skid plate, a clutch plate, a base member, and a string pully.

6. A yard game having particular utility for being relatively safely played by two or more children and/or adults of different skill and physical abilities, in combination comprising:
   - a playing court (55, 56) having a center line (65),a first foul-line position (59), a second foul-line position (58), and a third foul-line position (57);
   - a pair of spaced apart vertically mountable support poles (11) each being set in position at said center line;
   - support means (21) connected to each of said pair of support poles for holding said support poles in a vertical orientation to said playing court;
   - an elongate rod (12) dimensioned for being rotatably mounted between said support means;
   - a pair of mounting means (15) each having a skid plate (27), a clutch plate (28), a base member (29), each base member having an aperture (31) dimensioned to snugly receive an upper end portion (32) of a respective one of said support poles and wall portions forming a hole (33) dimensioned to rotatably and mountably accommodate a portion (34) of said rod, said clutch plate having wall portions forming a hole (35) for slidably receiving a portion of said rod, said skid plate having wall portions defining a central hole (40) dimensioned for receiving a portion of said rod and being secured to said rod, biasing means (38) for urging said clutch plate into friction engagement with said skid plate;
   - a pair of string pully means (30) affixed to a portion of said rod;
   - a pair of cords (44, 45) each having a predetermined length and affixed at one end to a respective one of said pair of string pully means and having its other end hanging downwardly from said string pully means;
   - a pair of score weights (16, 17) each affixed to a respective one of said downwardly hanging ends of said pair of cords;
   - score point indicia means (50) on at least one of said support poles for indicating the scoring relative to the position of a respective one of said score weights;
   - a paddle wheel (25) affixed to an intermediate portion of said rod; and
   - tossing means (20) for being tossed at said paddle wheel.

* * * * *